US006622793B1

(12) United States Patent
Rylov et al.

(10) Patent No.: US 6,622,793 B1
(45) Date of Patent: Sep. 23, 2003

(54) METHOD FOR CARRYING OUT OPERATIONS ON PETROLEUM AND GAS FIELDS AND DEEP-SEA PLATFORM FOR REALIZING THE SAME

(75) Inventors: Igor Igorevich Rylov, ul. Kastanaevskaya, d. 35, k.2 kv. 63, Moscow (RU), 121108; Sergey Alexandrovich Vasiliev, Nizhny Novgorod (RU); Anna Igorevna Krasulina, Moscow (RU); Igor Igorevich Rylov, Moscow (RU)

(73) Assignee: Igor Igorevich Rylov, Moscow (RU)

( * ) Notice: Subject to any disclaimer, the term of this patent is extended or adjusted under 35 U.S.C. 154(b) by 0 days.

(21) Appl. No.: 09/980,188

(22) PCT Filed: Jun. 1, 1999

(86) PCT No.: PCT/RU99/00183

§ 371 (c)(1),
(2), (4) Date: Feb. 25, 2002

(87) PCT Pub. No.: WO00/73622

PCT Pub. Date: Dec. 7, 2000

(51) Int. Cl.[7] ..... E21B 29/12

(52) U.S. Cl. ..... 166/364; 166/356; 166/354; 175/8; 405/192

(58) Field of Search ..... 166/364, 354, 166/356; 175/8, 10; 405/190, 191, 188, 192

(56) References Cited

U.S. PATENT DOCUMENTS

| | | | | | |
|---|---|---|---|---|---|
| 2,669,431 | A | * | 2/1954 | Crowell | 175/1 |
| 3,095,048 | A | * | 6/1963 | O'Neill et al. | 175/6 |
| 3,247,672 | A | * | 4/1966 | Johnson | 405/210 |
| 3,488,967 | A | | 1/1970 | Toosi | |
| 3,504,741 | A | | 4/1970 | Baker et al. | |
| 3,516,489 | A | * | 6/1970 | Jergins | 166/353 |
| 3,525,388 | A | * | 8/1970 | McClintock | 166/356 |
| 3,545,539 | A | * | 12/1970 | Manning | 166/356 |
| 3,552,903 | A | * | 1/1971 | Townsend, Jr. | 166/356 |
| 3,602,320 | A | * | 8/1971 | Howard | 175/8 |
| 3,642,063 | A | * | 2/1972 | Jergins | 175/6 |
| 3,682,242 | A | * | 8/1972 | Brooks et al. | 166/336 |
| RE27,745 | E | * | 8/1973 | Brooks et al. | 166/336 |
| 3,902,553 | A | * | 9/1975 | Jergins | 166/352 |
| 4,010,798 | A | * | 3/1977 | Corgnet | 166/356 |
| 4,054,104 | A | * | 10/1977 | Haselton | 114/264 |
| 4,321,720 | A | * | 3/1982 | Havre | 441/5 |
| 4,442,900 | A | * | 4/1984 | Padilla et al. | 166/342 |
| 4,502,551 | A | * | 3/1985 | Rule et al. | 175/6 |
| 4,799,825 | A | * | 1/1989 | Meyerhoff et al. | 405/188 |
| 4,913,590 | A | * | 4/1990 | Svenning et al. | 405/188 |
| 5,098,219 | A | | 3/1992 | Harrington | |
| 5,215,410 | A | * | 6/1993 | Karal | 405/205 |

FOREIGN PATENT DOCUMENTS

| | | |
|---|---|---|
| RU | 2014243 | 6/1994 |

OTHER PUBLICATIONS

Sukhanov, S.O., Burovoe atomuoe podvodnoe sudn., Sep. 23–26, 1997r, the abstracts of the reports, St. Petersburg, TSNII ak. Krylova A.N. p. 398.

(List continued on next page.)

*Primary Examiner*—Robert E. Pezzuto
*Assistant Examiner*—Thomas A Beach
(74) *Attorney, Agent, or Firm*—Killworth, Gottman, Hagan & Schaeff, LLP

(57) ABSTRACT

A method for carrying out operations on petroleum and gas fields is provided. The method involves using a platform which is located underwater when in working position at a depth where it is not subject to storm waves or under the lower surface of an ice field. The platform is made in the form of a structure which is water-tight and which includes an inner volume in which all the equipment, systems and structures are provided. The platform is directed from the surface using a surface complex which moves on the water or the ice field at the same speed as that of the current or the ice drift in the opposite direction.

9 Claims, 6 Drawing Sheets

OTHER PUBLICATIONS

Lavkovsky, S.A. et al., II mezhdnnarodnaya konferentsya, St. Petersburgski gosudarstenny.tekhnichesky universitet, 1996, pp. 38–40.

Kurashev, V. Dolgaya doroga k shelfy, Heft i kapital, The journal for CIS decisionmakers, 1997, pp. 80–83.

Mirzoev, D.A., "Specific features of design and technology for development of the Arctic oil fields", "Hydraulic Engineering", 1994, No. 3, pp. 24–29.

* cited by examiner

METHOD FOR CARRYING OUT OPERATIONS ON PETROLEUM AND GAS FIELDS AND DEEP-SEA PLATFORM FOR REALIZING THE SAME

BACKGROUND OF THE INVENTION

The invention relates to methods of performing oil and gas production in deep-sea areas with hard hydrometeorological and climatic conditions and to a construction of marine hydraulic engineering structures, in particular, to deep-sea platforms.

Known in the art is a relevant method of oil and gas recovery in deep-sea areas of the ocean with hard hydrometeorological and climatic conditions including performance of such a job from a platform provided with all necessary basic and auxiliary equipment, including energy and life support devices with the respective building structures and constructions (cf. Mirzoev D. A. "Specific features of design and technology for development of the Arctic oil fields", "Hydraulic Engineering", 1994, 1994, No. 3, pp. 24–29).

Also known in the art are devices such as a deep-sea platform including an upper structure, a support part and a foundation, basic and auxiliary equipment required for performing oil and gas recovery, energy and life support with respective building structures and mechanisms (cf. Mirzoev D. A. "Specific features of design and technology for development of the Arctic oil fields", "Hydraulic Engineering", 1994, 1994, No. 3, pp. 24–29).

The disadvantages of the known methods and devices for deep-sea shelf areas of the ocean with hard hydrometeorological and climatic conditions (including the Arctic shelf areas) is a necessity of withstanding significant static and dynamic loads with a large load arm and, as a consequence, a large volume of building materials used for heavy-duty robust support structures and foundations, and high labor consumption for performing all building and assembly jobs and prospecting. As for buoyant platforms, the work must be ceased at a high wind and waves, there is a danger of tumbling during icing, adverse working conditions for the people, equipment, building structures and mechanisms. As a result, the cost of building the structures and performing the oil and gas recovery is high.

SUMMARY OF THE INVENTION

An object of the present invention is to change the conditions of execution of oil and gas recovery allowing one to avoid the affects of the ice, storm and other loads on the offshore oil and gas production platforms and the associated facilities, to substantially reduce the scope of the building and assembly works and engineering prospecting, as well as to reduce the material and labors cost when building the foundations and support structures, to improve the operating conditions of the personnel, equipment, building structures and structural members, to increase safety of the personnel, reliability of the structures and protection of the environment at primary and emergency blowouts of hydrocarbons and in other emergency situations thus considerably reducing the platform cost, labor cost and time needed of its erection, to expand the area of the oil and gas fields serviced by the platform, to increase the platform mobility with a possibility of its transfer both over the oil field area and in other areas, and to considerably expand the range of oil and gas recovery area on the shelf and adjacent zones of the ocean including the Arctic Zone.

This object is attained by providing a method for carrying out operations on oil and gas fields in deep-sea areas of the ocean with hard climatic and hydrometeorological conditions performed from a platform, provided with all necessary basic and auxiliary equipment including energy and life support systems with respective building structures and facilities. The operations are carried out from a platform, which is located underwater at a depth where it is not subjected to the effect of storm waves or below the undersurface of an ice field. In the process of oil production the platform is supported by a surface complex moving on the water or ice field surface at a speed of the water current or ice drift in an opposite direction, or by a ground-based stationary complex with communication means with the platform and outside world, as well as a set of evacuation and other life saving equipment, as well equipment and instruments for remote control of the production processes on the platform.

With respect to the platform construction, the object of the invention is attained due to the fact that the deep-sea platform includes basic and auxiliary equipment required for performing oil and gas production, energy and life support with the respective building structures and facilities. The platform is made as a closed construction with positive buoyancy water-tight and gas-tight from above and from all sides with an inner space accommodating all equipment, structures and units with ballast compartments and an open drilling well passing through the bottom of the platform with devices for maintaining the necessary air pressure or respiratory mixture and other working gases in the inner space. The walls of the platform are designed for emergency pressure and temperature: they are three-layer with a load-carrying external shell, an internal shell divided into sections interconnected through dowels, and intermediate space between the shells filled with pads of a strong elastic material filled by fluid or gas under a necessary pressure.

The proposed platform may be furnished with floating air inlets controlled from the platform to be placed in preliminarily prepared in ice lane and stacked in non-working state on the platform deck.

The proposed platform can be furnished with underwater reservoirs secured to it from outside and having a shell made of a strong water-tight and a gas-tight material having high thermal conductivity with an outlet in the bottom provided with a cleaning filter, said reservoirs being previously filled with air or inert gas and communicating through pipe lines with a head of a drilling string. Mounted at the end of the pipeline in the inner space of the shell is a burner controlled from the platform, which is fed with oxygen through an additional pipeline.

The proposed platform may be furnished with underwater reservoirs located outside and used for collection of primary or emergency volumes of gas, condensate or oil, said reservoirs being connected to the drilling string head through pipelines. The underwater reservoirs have double shells made of a gas-tight, oil-tight and water-tight material, the external shells being load-carrying and the internal ones being flexible and elastic preliminarily filled with air or water so that an opening is formed in the bottom of reservoirs communicating with the inner space of the internal shell with the environment. The crude oil feed pipelines are arranged in the space between the external and internal shells.

The proposed platform may be also furnished with an end sleeve located at the outlet of the drilling well connected to the platform through a flexible gas-tight, oil-tight and water-tight joint having at its lower end a sliding ring packing preventing pollution of the environment by hydrocarbon crude and the drilling fluid in case of an emergency rise or submergence of the platform. The upper end with the drilling string head moves freely inside the sleeve, and its length is determined by the difference of the marks of the upper end of a string in its extreme working position before building-up of a next link of the string and the bottom of the emerged platform with a correction for its drift with the ice field.

In a proposed platform for the period of a well sinking operation, the drilling string may be provided with a cylindrical collar encompassing the upper part of the drilling string and secured thereon pressure-tight through the upper end under drilling string head and the lower end overlapping the upper end of the casing pipe entering the open oil mine of the platform with a flange freely passing through the shaft and tightly connected with an axially squeezed sleeve made of a strong elastic material, while the lower end is tightly secured on the thrust flange on the casing pipe.

The supports of the proposed platform can be secured in massive support blocks freely lying on the seabed with their macrorough lower surface.

The proposed platform may also be furnished with a reservoir of a respective volume secured to the platform hull and consisting of elastic water-tight and gas-tight material folded in inactive state and filled when necessary, by command from the platform or from the surface complex.

The technical result achieved with the help of this set of features consists in that the oil-and gas-field works in deep-sea shelf areas with hard hydrometeorological and climatic conditions including the Arctic Zone are carried out from a platform arranged in a bulk of water, at a depth not subjected to the effect of storm waves or below the under-surface of an ice field released from the affect of the wave and ice loads, as well as from icing thus removing the uncertainty in the magnitudes, directions and combined actions on the platform during its erection and operation and minimizes them, and also widens the range of oil and gas production on shelf and other zones of the ocean including the Arctic Zone. In so doing the platform is made in the form of a closed structure with an inner space accommodating all equipment, structures and units with energy and life support facilities. In this case the safety of the personnel, equipment and structures when performing oil and gas production is improved, the protection against fire and detonation is provided; the extent of security of production shops and the environment from emergency outbursts of oil, gas, drill fluid and products of incineration of associated gas is increased, the reliability and stability of the platform under unexpected circumstances is improved; and the platform is capable of maneuvering and moving both over the oil field and beyond it.

DETAILED DESCRIPTION OF THE PREFERRED EMBODIMENT

Figure 1:
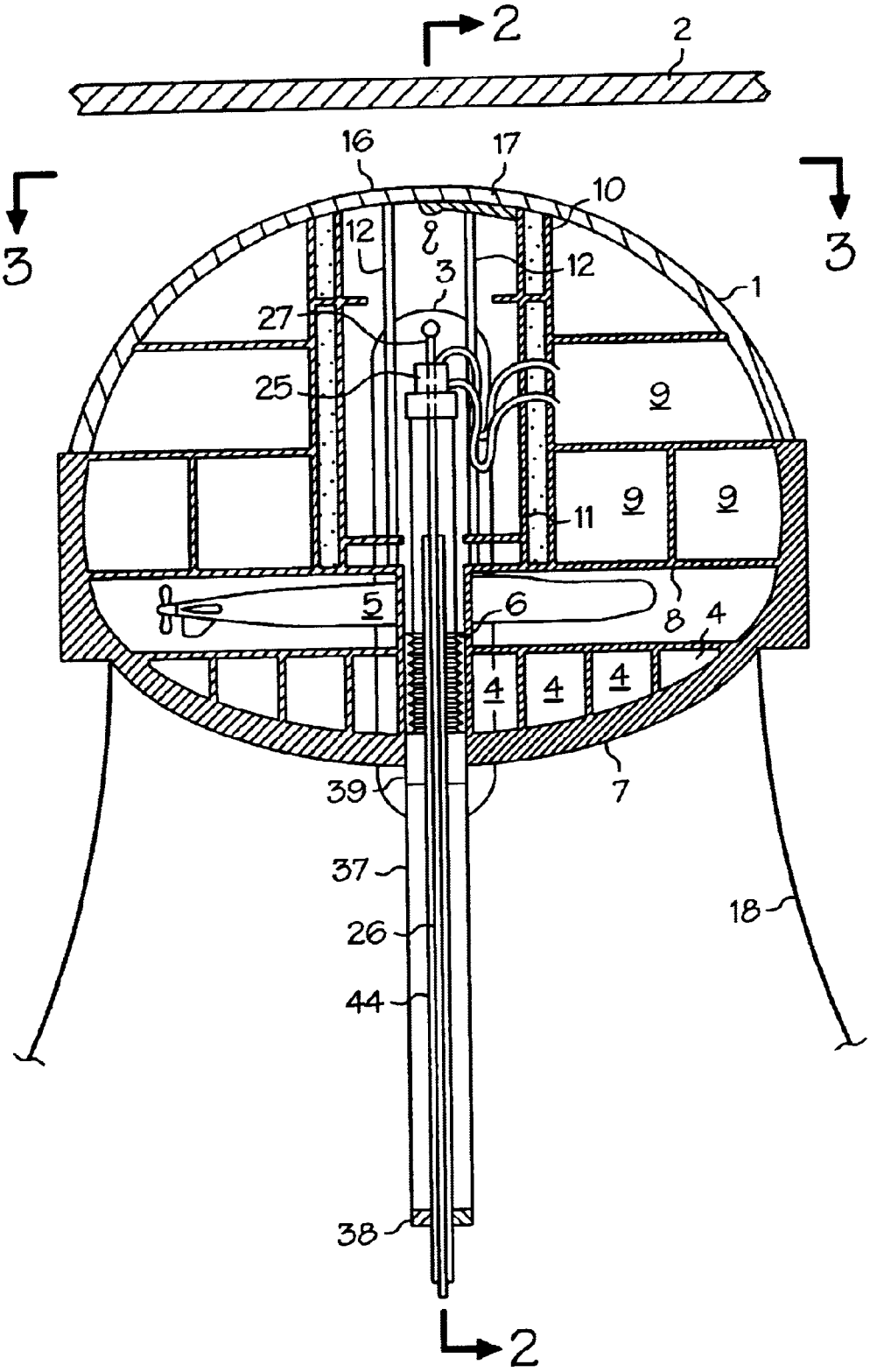
FIG. 1 is a longitudinal section of the platform with positive or controlled buoyancy in the operating (underwater) position.
Figure 2:
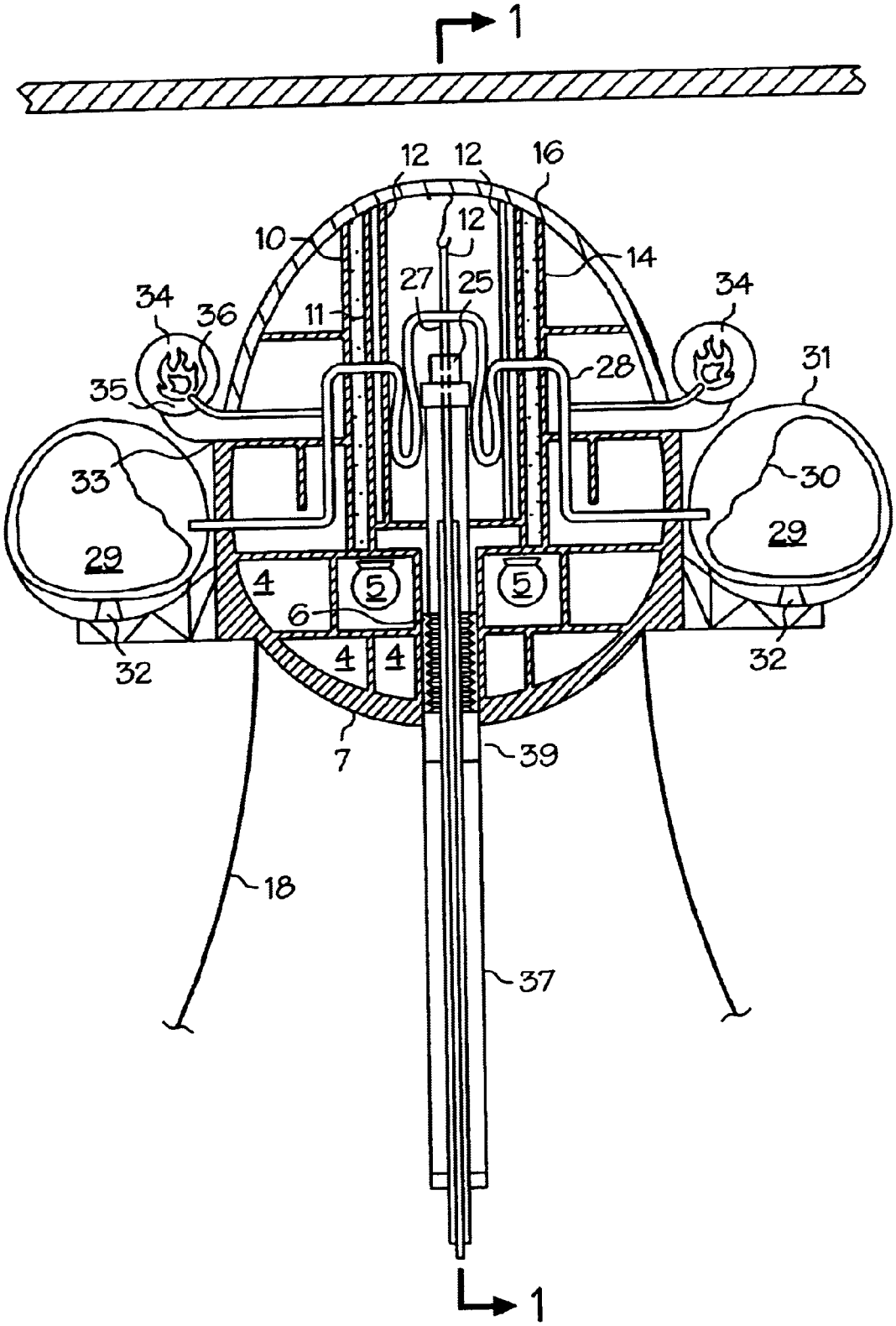
FIG. 2 is a cross-sectional view of the same platform.
Figure 3:
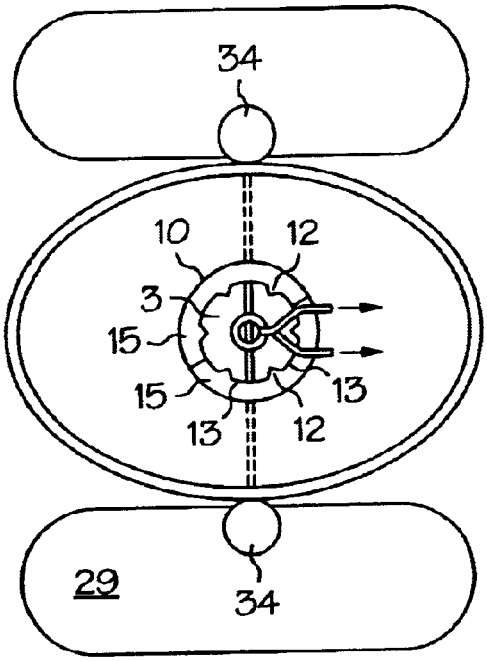
FIG. 3 is a plan view of the platform.
Figure 4:
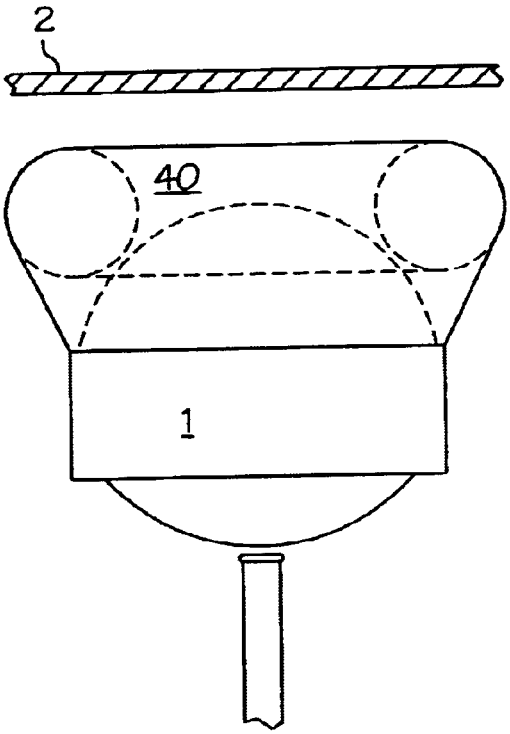
FIG. 4 illustrates the platform with a gas-filled reservoir providing buoyancy lost by the platform (the external reservoirs not shown)

The proposed method for carrying out operations on oil and gas fields is realized using a deep-sea buoyant platform 1, which in the operating position is either below the surface of the ice field 2, or under a layer effected by storm waves. The platform is a closed water-tight and air-tight structure whose inner space is used for accommodation of the main drilling compartment 3 and all equipment and structures (not shown), ballast compartments 4, air conditioning and reactivation units and devices for maintaining its necessary pressure in the inner space (not shown in the drawings), underwater vehicles 5 for effecting operative communication with the continent including transportation of the personnel and production cargoes.

The drilling compartment 3 is air-tight, gas-tight, oil-tight and water-tight from above and from all sides. It has an open oil mine 6, extending through the bottom of the platform 7 and filled with nitrogen or another inflammable inert gas of a required concentration with a pressure equal to the water pressure at a level of the floor 8 of the production and living space 9 of the platform 1. For this purpose, the compartment is furnished with a respective facility (not shown), the compartment walls consist of three layers, designed for emergency pressure and temperature and consist of a load-carrying external shell 10, internal shell 11 divided into sections 13 by compensating dowels 12 and intermediate spaces 14 between the shells 10 and 11, which is filled with pads 15 made of a strong elastic material filled with a fluid, for example, water or gas (air) under a design pressure.

The ceiling 16 of the main drilling compartment 3 has a manhole 17 to be opened after the platform has come to the surface during emergency or preventive refloating.

At an insignificant positive buoyancy adjusted by ballasting, the platform 1 is kept in the working position by supports 18 of an adjustable length secured in the massive support blocks 19 with a rough surface freely laying on the seabed. The maneuvering of the platform over the oil field is carried out by adjusting the length of the supports using onboard movers, if necessary. In the case of moving the platform within the oil field area or beyond it, the support blocks 19 are moved together with the platform.

The stretching supports of the platform 18 shown in FIGS. 1, 2, 5, 6 are one embodiment of the invention. The supports can be of another type, in particular, telescopic with an adjustment of their length depending on the situation.

The platform may be made without supports if it has controllable buoyancy and a system for dynamic positioning and stabilizing.

To perform the surface maintenance of the platform and to provide emergency evacuation and preventive works when rising the platform 1 on the surface of an ice field 2 or water, or onshore, when the oil field is near the shore, a surface complex 22 is provided with communication facilities with the underwater platform and with the outside world and a set of equipment and instruments for remote control of the production processes on the platform, as well with emergency evacuation and life saving equipment. On ice or water the complex moves at a speed of drift of ice or a sea current in an opposite direction. When the surface complex is placed and moved on an ice surface it can be mounted on cross-country chassis including amphibian and air-cushion vehicles or can be made as an icebreaker.

The surface complex and the platform can interact with a stationary coastal complex having a necessary set of equipment and communication facilities for controlling the operating processes on the platform.

If necessary, periodic air renewal in the inner space of the platform may be provided using air inlets 23 arranged on the platform hull and floating to the surface in preliminarily made lanes on the ice field 2 by a command from the platform and after performing the air intake returning to their storage place on the hull.

For capture of emergency and primary volumes of oil, condensate or gas when the drilling string enters the oil-and-gas bearing strata via the head 25 of the drilling strings 26 is provided with a branch pipe with a valve 27 connected to pressure-tight pipes 28 extending outside the platforms and connected with the buoyant underwater reservoirs 29, which receive the primary or emergency volume of oil, condensate or gas. The ballast compartments 4 may be considered as a spare reservoir for oil and condensate.

The reservoirs 29 are secured either on the platform 1, on which they are arranged symmetrically and filled simultaneously and uniformly for preserving the balance and stability of the platform, or are connected to the platform by flexible connections controlled from the platform or from the surface complex, and secured on support shoes laid on the seabed (not shown in the drawings).

To provide minimum variation of the buoyancy of the platform 1, reservoirs 29 for oil and condensate storage are made of a strong and flexible water-tight and oil-tight material or of a rigid water-tight and oil-tight material and, when empty, are compressed by the ambient sea water medium.

The reservoirs can be made of both flexible and rigid water-tight and gas-tight material. In the empty state they are filled with air and balanced at the expense of a heavy load in its near-bottom part with buoyancy close to zero. To provide minimum variation of buoyancy, both its own and the platform itself, when filling the reservoirs, the reservoirs 29 consist of two shells 30 and 31. The internal shell 30 is made of a flexible water-tight, gas-tight and oil-tight material.

The bottom of the internal shell 30 has a branch pipe 32 with a valve tightly fixed in the opening of the external shell 31 and communicating with the ambient medium. Gas, oil or condensate is fed via pipes 28 to a gap between the shells 30 and 31 and displace the air for gas or water for oil or condensate in the internal flexible shells 30 while preserving the initial buoyancy of the reservoirs.

If the petroleum or basic gas must be burnt in a flare for the period of boring and sinking the well, the gas fed to the platform through the pipelines 33 extending through an external enclosure of the platform enters the underwater reservoir 34 with a single-layer shell made of a fire-resistant, water-tight and gas-tight material of a high thermal conductivity with an opening in the bottom 35 equipped with a valve. The reservoir is preliminarily filled with air or inert gas. The end of the pipeline 33 entering the reservoir 34 is provided with a burner 36 controlled from the platform or from the surface complex, to which oxygen is supplied from the platform through an additional pipeline to provide a process of burning. The combustion products acted on by the pressure in the reservoir 34, corresponding to the depth of its submergence respective to depth, automatically discharge into the ambient aqueous medium through an outlet 35 in the reservoir bottom. In order to protect the environment from harmful effects of the products of combustion, the outlet 35 is provided with a cleaning filter. The same reservoirs can be used for removal of exhaust and exit gases of the power installations. To maintain the balance and stability of the platform and a reservoir reserve for the "flares" 34, two or several reservoirs are installed symmetrically to the vertical axis of the platform and extending through its center of mass.

To avoid an uncontrollable blowout of oil, condensate or gas into the environment, as well as a spill of the drilling fluid or slurry during the emergency surfacing of the platform, the shaft outlet is provided with a piece of a tube or a sleeve 37 whose length is determined by the difference of the marks of the head 25 of the string 26 in its extreme operating position (before building-up a next link of the string) and the bottom 7 of the floating platform 1 taking into account its drift with the ice field for the time required for closing all necessary gate valves.

The inner diameter of an end sleeve 37 allows the string 26 with the head 25 to freely move in this sleeve.

A ring packing 38 is installed at the lower end of an end sleeve 37 to prevent a blowout of the hydrocarbon crude and drilling fluid into the ambient aqueous medium. At the bottom 7 of the platform the end sleeve 37 is fastened to the platform with by means of a swiveling seal 39 allowing the string 26 with a sleeve 37 to deflect from the axis of the oil mine 6 in a wide range.

For the case of loss of buoyancy the platform 1 is furnished with a reservoir 40 having a required volume and secured on the hull outside the platform. This reservoir is made of an elastic water-tight and gas-tight material folded in a non-working state and, when necessary, filled with gas by a command from the platform.

As an additional barrier against emergency blowout of hydrocarbon crude into the space inside the platform, a cylindrical collar 41 is provided encompassing the upper link of the drill pipe 26 tightly secured thereon by an upper head 42 under the head 25 of the drill pipe 26. The lower end 43 of the collar 41 having a diameter of the casing pipe 44 in the extreme upper position overlaps the upper end 45 of the casing pipes and has a flange 46 whose external diameter is close to the inner diameter of the oil mine 6 so that it freely passes through it. Secured to the lower face of the flange 46 is a flexible sleeve compressed along its axis and made of an elastic gas-tight and oil-tight material, the cross-section of this sleeve inscribing in the cross-section of the tightly secured to the thrust flange 48 of the casing pipes 44.

Figure 5:
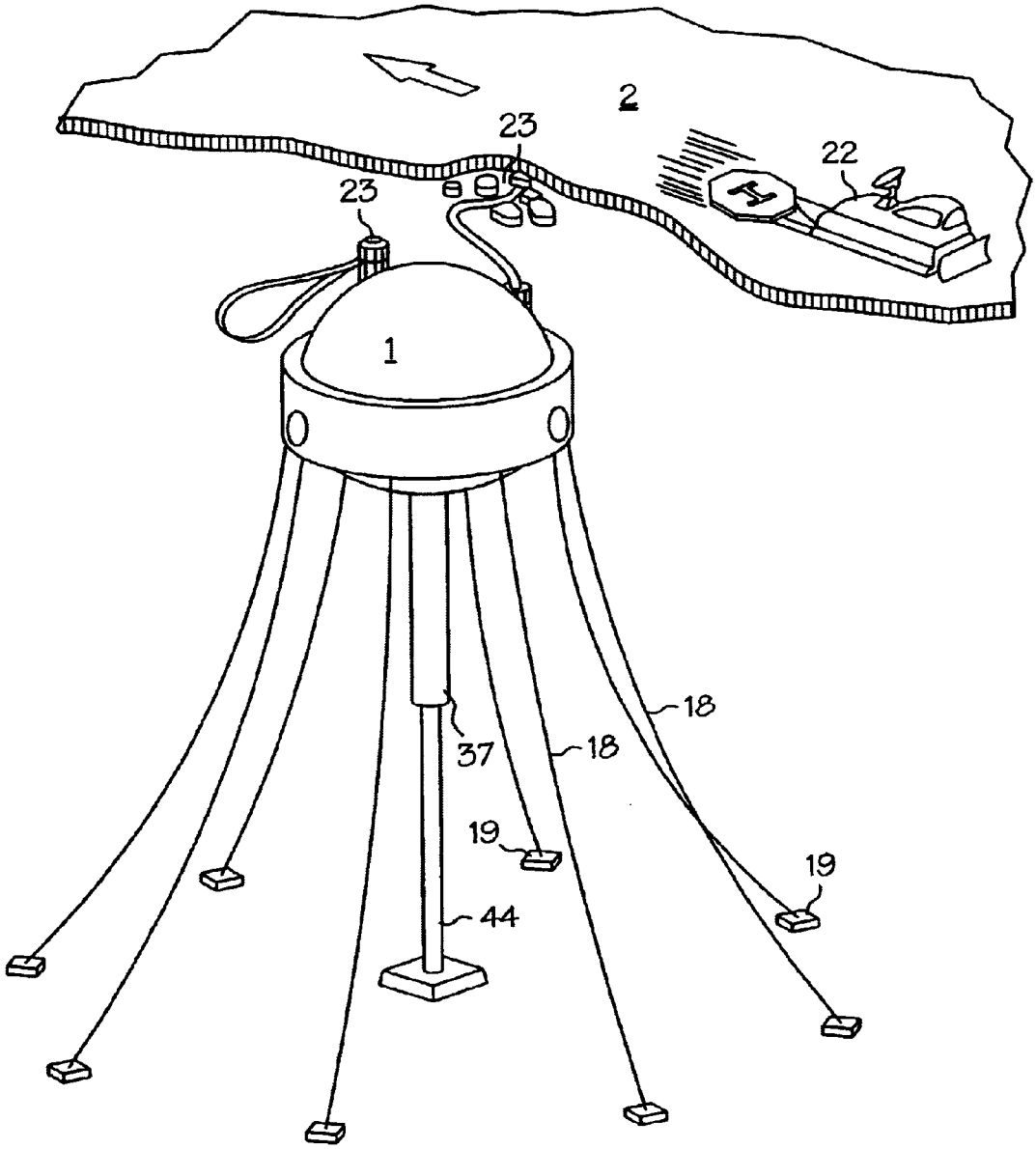
FIG. 5 is a general view of the platform in the operating (underwater) position with a surface complex (the external reservoirs are not shown)
Figure 6:
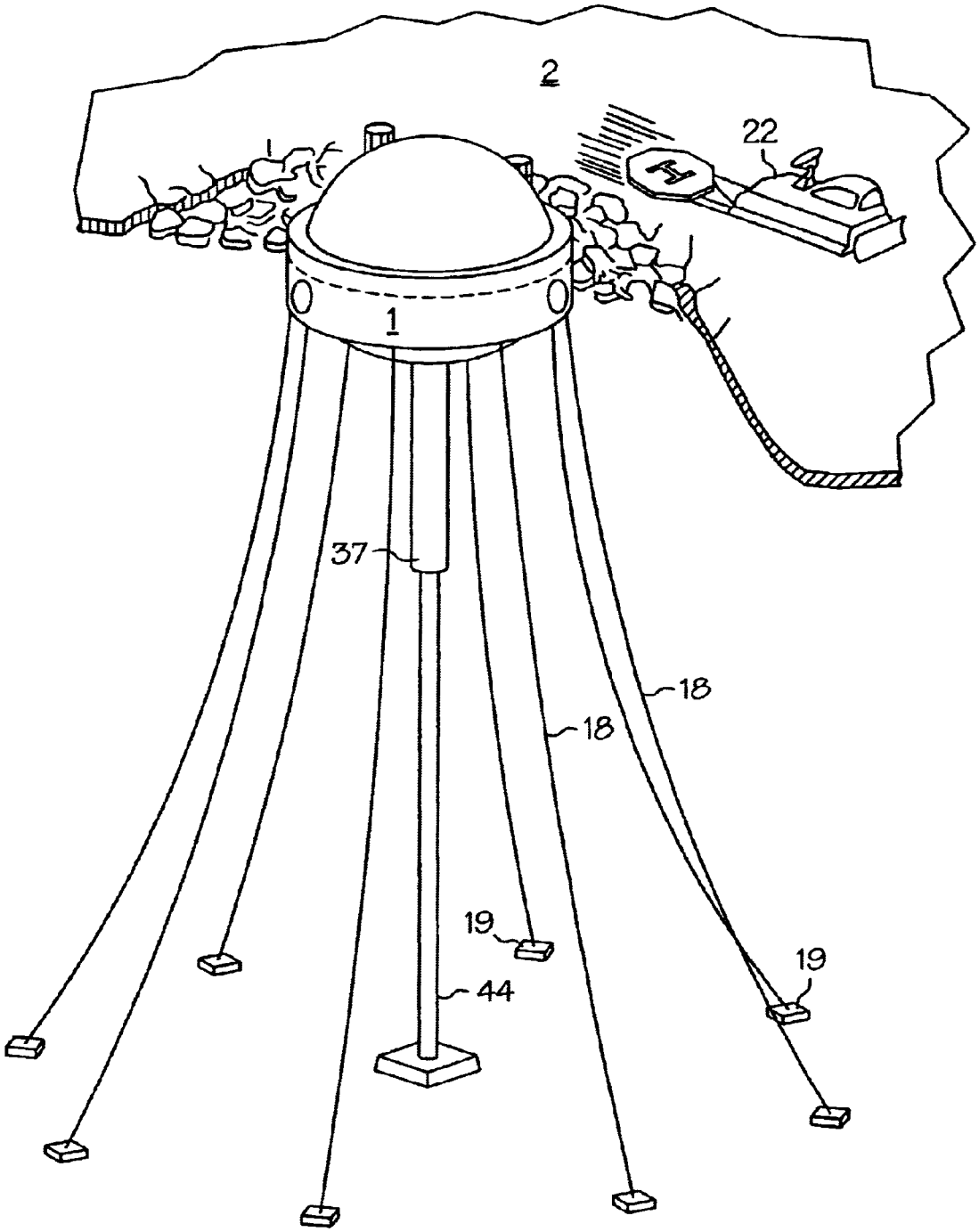
FIG. 6 is a view of the platform after emergency or preventive surfacing.
Figure 7:
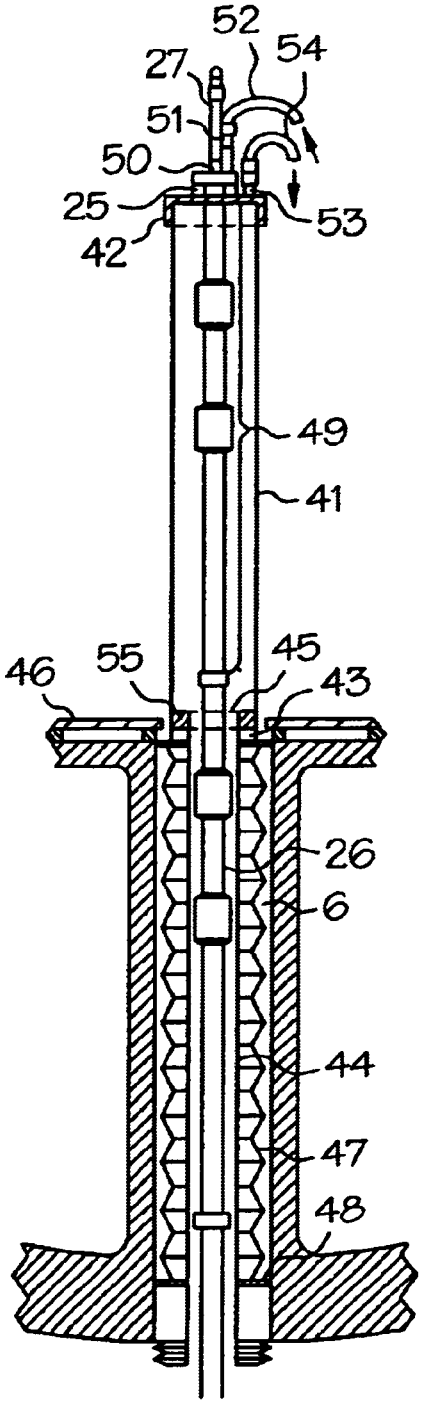
FIG. 7 illustrates the unit A of FIG. 1, which is an additional device for preventing emergency outburst of hydrocarbons.
Figure 8:
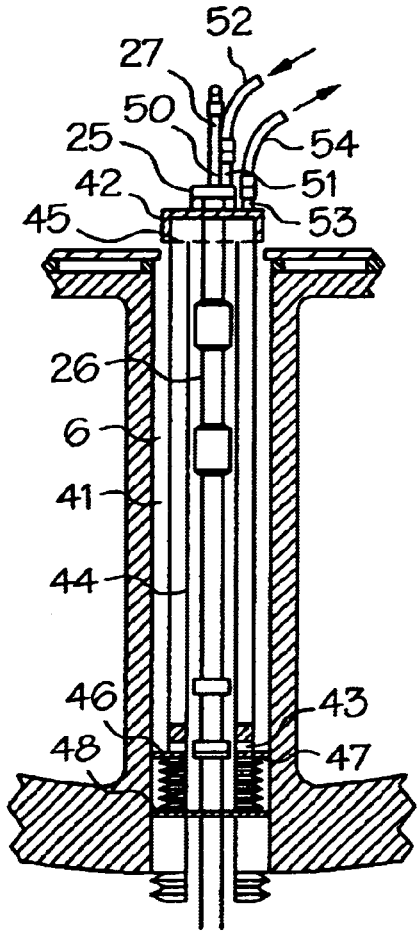
FIG. 8 illustrates the unit A of FIG. 1 in the lower position after sinking the well before operation of the upper link of the drilling string.

After the installation of a regular link in the drill pipe 26 and its immersion into the seabed, the collar 41 with the sleeve 47 is set in the upper position shown in FIG. 5. As the drill pipe comes down in the process of hole making, the collar 41 together with the upper part of the drill pipe is sunk in the lower position shown in FIG. 6 into the open oil mine 6 of the platform. In so doing the sleeve 47 is compressed along its axis.

Then the heads 25 and 42 are removed from the drill pipe and collar 41, a regular link 49 is secured to the upper end of the drill pipe, and the collar 41 with the flexible sleeve 47 are withdrawn from the oil mine 6. In so doing the flexible sleeve straightens itself up, and the heads 42 and 25, the drill pipe, collar 41 and sleeve 47 occupy their initial position (FIG. 5).

In case of an emergency blowout of hydrocarbon crude in the process of hole making, a part of hydrocarbon stream raising in the drill pipe 26 after filling the reservoirs 29 is locked due to the operation of the cutoff gate valve 50 in the branch pipe 27 of the head 25 and the gate valve 51 in the drilling fluid feeding pipeline 52; the part of the flow rising up in the casing pipe 44 enters the space of the collar 41 and, being locked due to the closing of the gate valve 53 in the drilling fluid outlet pipe 54 and then through the seal 55 preventing leakage of the recycling drilling fluid (and slurry), enters the space of the sleeve 47, which in this case is pushed against the walls of the oil mine 6 but is unable to move further. Thus, any output of hydrocarbon crude into the space of the platform and ambient medium is prevented (in addition and as a backup barrier to the installed standard blowout preventer.

In this case the fastening and sealing of the heads 25 and 42, gate valves 50, 51, 53, flanges 43, 48, collar 41, and the walls of oil mine 6 must be calculated for the pressure of emergency blowouts of the hydrocarbon crude. The control of the production processes is performed from the rooms located outside the drilling compartment 3 with visual observation using video cameras or through windows, or from the surface complex. The operating personnel in the compartment may be present only when transferring components and materials through lock chambers (not shown in the drawings), assembly, preventive maintenance and readjustment. The operators come into this compartment through lock chambers for short-term stay with the use of respiratory apparatus; and for a stay air or a respiratory mixture replaces the inert gas.

The platform 1 is assembled on a coastal assembly base or in a dock, where it is equipped with all necessary equipment and devices with primary consumables, supports 18 connected with the support blocks 19 and other facilities loaded on special accompanying carrier vessels or barges accompanied by ice breakers to the installation site, where the support blocks 19 with anchored stretching supports 18 are unloaded from the carrier vessel (or vessels), lowered under water (or ice) and then the platform installed in the working position by means of ballasting and tensioning the stretching supports 18.

Having completed the drilling job on the well cluster, the platform 1 can be moved from one site to another on an oil field or on another area by replacing the support blocks 19 with the help of floating hoisting devices and adjusting the length of the stretching supports 18.

As a special case, at a shallow depth the platform can be placed on the seabed.

When the surface is free from ice and in calm weather, the platform may be raised to the surface and used for oil and gas recovery under normal conditions.

What is claimed is:

1. A method for performing oil and gas recovery in deep-sea areas of an ocean comprising:

providing a deep-sea platform comprising an air-tight, water-tight housing including an inner space for accommodating equipment and a drilling compartment comprising a drilling apparatus which extends through the bottom of said housing; said drilling compartment being supported by walls comprising an external shell, an internal shell, and an intermediate space between said external shell and internal shell containing a fluid or gas under pressure; and providing a surface complex in communication with said platform; wherein said complex moves at a speed of a water current or drifting ice in an opposite direction thereto; and lowering said drilling apparatus into a seabed and extracting oil or gas therefrom.

2. A deep-sea platform for performing oil and gas recovery in deep-sea areas of an ocean comprising:

an air-tight, water-tight housing including an inner space therein; and a drilling compartment within said inner space comprising a drilling apparatus which extends through the bottom of said housing; said drilling compartment being supported by walls comprising an external shell, an internal shell, and an intermediate space between said external shell and internal shell containing a fluid or gas under pressure.

3. The deep-sea platform of claim 2 including air inlets for providing air to said inner space.

4. The deep-sea platform of claim 2 including at least one underwater reservoir affixed thereto for storing gas, oil or condensate, said reservoir comprising an internal shell and an external shell; wherein said gas, oil, or condensate enters said reservoir between said internal and external shell.

5. The deep-sea platform of claim 2 including at least one underwater reservoir affixed thereto for burning of petroleum or gas and removal of exhaust gases; said reservoir comprising a fire-resistant shell and including an outlet with a cleaning filter therein.

6. The deep-sea platform of claim 2 further including an end sleeve at the bottom of said platform for preventing blowout of oil, condensate or gas into the environment, said end sleeve including a sliding ring packing at one end.

7. The deep-sea platform of claim 2 wherein said drilling apparatus includes a drilling well comprising a drill pipe having a cylindrical collar around its diameter for preventing blowout of hydrocarbon crude into said inner space of said housing.

8. The deep-sea platform of claim 2 including a plurality of supports for installing said platform in a working position, said supports comprising stretching supports affixed to support blocks which are adapted to lie on the ocean floor.

9. The deep-sea platform of claim 2 including a reservoir affixed thereto to prevent loss of buoyancy, said reservoir comprising a water-tight, air tight material which is folded when in a non-working state and filled with gas when in use.

* * * * *